United States Patent [19]

Bradley et al.

[11] Patent Number: 4,886,218

[45] Date of Patent: Dec. 12, 1989

[54] MANTLE WITH REPLACEABLE WEAR PLATES

[75] Inventors: Norman F. Bradley, Burnaby; Craig H. Chamberlain, Vancouver, both of Canada

[73] Assignee: CAE Machinery Ltd., Vancouver, Canada

[21] Appl. No.: 287,728

[22] Filed: Dec. 21, 1988

[51] Int. Cl.[4] ..... B02C 7/12

[52] U.S. Cl. ..... 241/294; 241/261.1; 241/300

[58] Field of Search ..... 241/294, 300, 261.1

[56] References Cited

U.S. PATENT DOCUMENTS

| | | | |
|---|---|---|---|
| 692,886 | 2/1902 | Mason, Jr. | 241/294 |
| 1,187,159 | 6/1916 | McKee et al. . | |
| 2,465,607 | 3/1949 | Roubal | 241/300 |
| 3,153,512 | 10/1964 | Polzin | 241/219 X |
| 3,353,758 | 11/1967 | Whaley et al. . | |
| 4,065,064 | 12/1977 | Anthony . | |
| 4,394,982 | 7/1983 | Wilson . | |
| 4,609,158 | 9/1986 | Wilson . | |

FOREIGN PATENT DOCUMENTS

| | | | |
|---|---|---|---|
| 377438 | 6/1923 | Fed. Rep. of Germany | 241/300 |
| 3126563 | 5/1988 | Japan | 241/300 |

*Primary Examiner*—Timothy V. Eley

*Attorney, Agent, or Firm*—Christie, Parker & Hale

[57] ABSTRACT

A mantle for use with a rock crushing apparatus comprising an essentially tubular mantle body having side walls defining an exterior surface and a hollow interior being adapted to fit over the main shaft of a rock crushing apparatus. Wear plates for attachment to the exterior of the mantle body are provided, an adhesive filling material being used between the mantle body and the wear plates. A system of locking bolts are used to removably locate the wear plates to the outer surface of the mantle body.

12 Claims, 2 Drawing Sheets

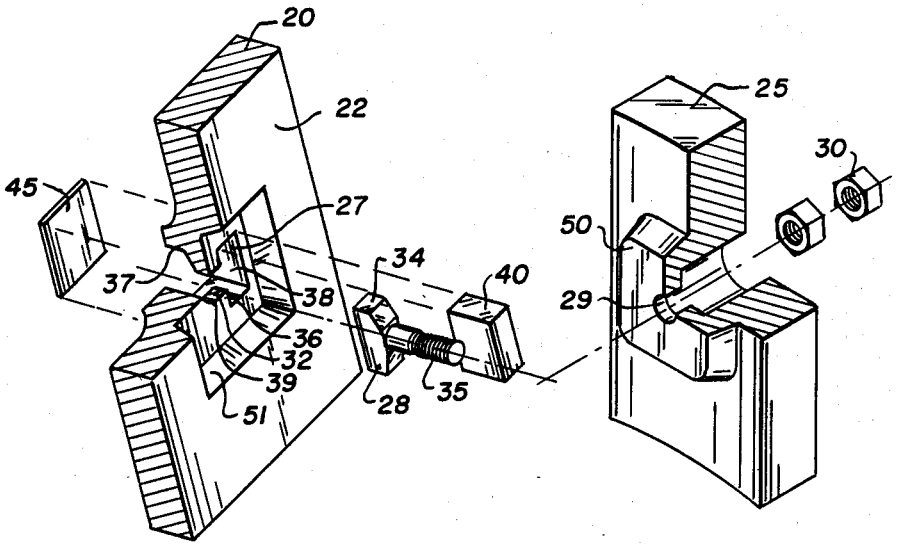
Fig. 3.
Fig. 4.
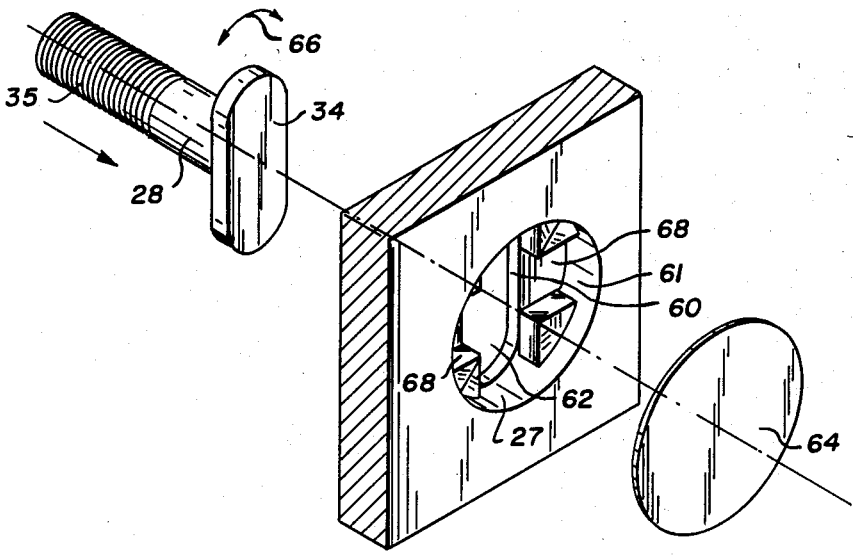

MANTLE WITH REPLACEABLE WEAR PLATES

FIELD OF THE INVENTION

This invention relates to a mantle for use in a gyratory rock or ore crushing apparatus.

BACKGROUND OF THE INVENTION

Rock crushing devices for reducing the size of rocks or other pieces of ore or the like are well known in the prior art. Many of these rock crushing devices have been developed that use replaceable wear plates. U.S. Pat. Nos. 1,187,159 to McKee et al., 2,465,607 to Roubal and 3,153 512 to Polzin all disclose jaw crushing devices having replaceable wear plates bolted to the faces of a pivotable crushing jaw. U.S. Pat. No. 4,394,982 to Wilson discloses a grinding mill that also uses bolted wear plates. U.S. Pat. No. 4,609,158 to Wilson teaches a replaceable liner assembly for the interior shell of a grinding mill that employs a wedge element to hold a replaceable wear insert in place.

Replaceable wear plates for gyratory rock crushers have also been developed. Conventional gyratory rock crushers employ a large open, essentially conical, chamber or pit within which a main shaft rotates. A crusher mantle conforming essentially to the shape of the chamber is fixed on the main shaft for rotation within the open chamber. Material to be crushed is poured into the chamber and is ground into smaller particles between the mantle and the chamber walls as the mantle rotates. U.S. Pat. No. 3,353,758 to Whaley discloses a crusher liner that is affixed to the inner surface of the crushing chamber by a layer of relatively low melting point metal such as zinc. Wooden dowels are used to space the liners away from the chamber walls and act to absorb and distribute compressive loads. U.S. Pat. No. 4,065,064 to Anthony discloses wear resistant linings that are bolted to the inside wall of the lower portion of the chamber. Unfortunately, neither Whaley nor Anthony address the problem of the tremendous wearing forces to which the crusher mantle is subjected.

Most conventional gyratory rock crushers still do not employ replaceable wear liners. Instead, the outer surface of the mantle and the walls of the chamber have specially hardened surfaces to withstand the large abrasion forces experienced during crushing operations. Conventional rock crushers use mantles constructed from one or two piece manganese steel castings. When suitably work hardened to around 500 Brinell, these mantles provide fairly good wear life. However, to adequately work harden a manganese steel mantle and keep it work hardened means that the crusher must be continually flooded with ore. The problem with a great deal of crushers is that this necessary flooding cannot be maintained and, as a result, the manganese steel does not obtain or retain an adequate hardness level resulting in faster wear of the mantle. In addition, there is also a problem with selective wear of the mantle in that the lower portion of the mantle tends to do most of the crushing work and consequently receives most of the wear.

At present, a manganese steel mantle requires repair or replacement approximately every ten weeks. This repair process involves removing the mantle from the main shaft and building up the worn areas of the mantle by overlaying the mantle and then welding on manganese plates. Needless to say, such an operation is very labour intensive and time consuming. A mantle can be rebuilt in this manner many times, but eventually a complete replacement of the mantle is generally necessary.

SUMMARY OF THE INVENTION

The present invention seeks to provide a mantle that addresses the wear and maintenance problems that exist with conventional manganese steel mantles. Accordingly, the present invention provides a mantle for use with a rock crushing apparatus comprising:

an essentially tubular mantle body having side walls defining an exterior surface and a hollow interior being adapted to fit over the main shaft of a rock crushing apparatus;

wear plates for attachment to the exterior of said mantle body;

an adhesive filling material for placement between said wear plates and said mantle body; and locating means to allow said wear plates to be removably located on said mantle body.

The mantle of the present invention uses wear plates attached to a mantle body that are easily changed and replaced to greatly simplify and speed up the process of rebuilding the mantle.

In a preferred embodiment, the wear plates of the present invention are made from chrome-molybdenum steel having a hardness of approximately 360 Brinell providing a longer operating life for each set of wear plates.

As well, the mantle of the present invention provides significant cost savings in that only the wear plates are periodically replaced making unnecessary the current expensive practice of periodic replacement of the entire mantle after a certain number of rebuilds.

BRIEF DESCRIPTION OF THE DRAWINGS

Preferred embodiments of the present invention are shown in the accompanying Figures in which:

FIG. 3 is an exploded view showing a locating means for locating a wear plate on the mantle body; and FIG. 4 is an exploded view showing alternative locating means.

DESCRIPTION OF THE PREFERRED EMBODIMENTS

Figure 1:
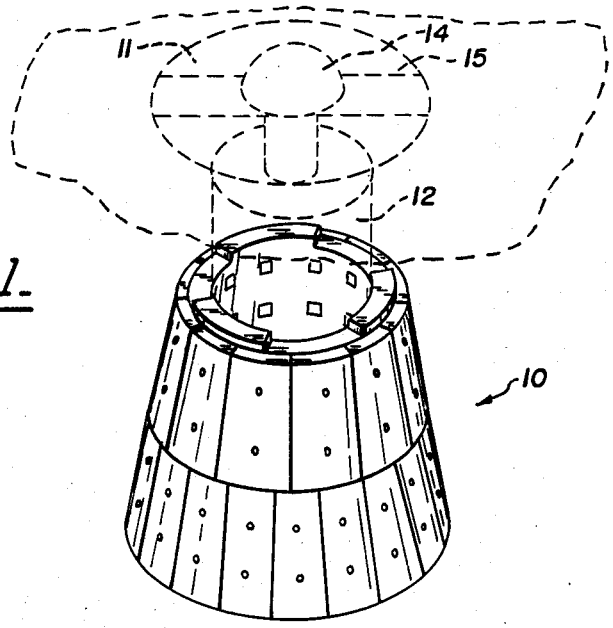
FIG. 1 is perspective view showing the mantle of the present invention in place on the main shaft of a conventional rock crusher.

FIG. 1 shows a mantle 10 according to a preferred embodiment of the present invention in place within a conventional gyratory crusher shown by dashed lines. The mantle 10 is located within pit 11 on main shaft 12 of the crusher. Main shaft 12 is supported at its upper end by bearing 14 which is supported across opening 15 through which material is fed into the crusher pit. The upper edge of the mantle is castellated for engagement with a correspondingly formed edge on an upper mantle (not shown) that covers the main shaft.

Figure 2:
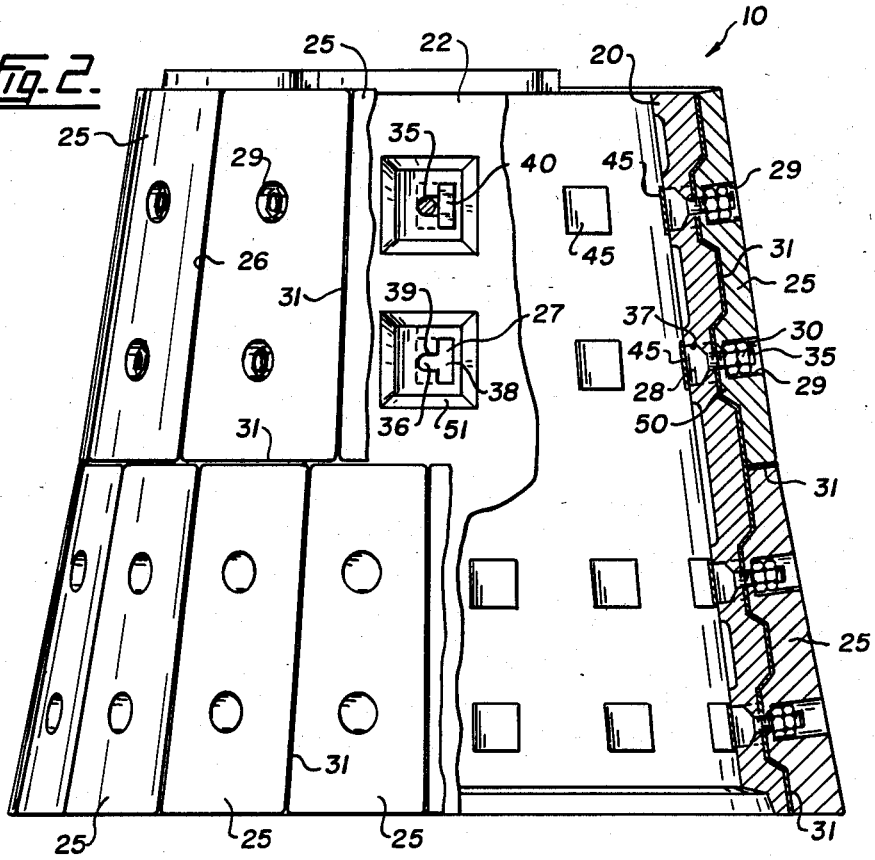
FIG. 2 is an elevation view of the mantle with cutaway sections showing the exterior surface of the mantle body, the interior surface of the mantle body, and a cross-section through the side walls and wear plates of the mantle.

Referring to FIG. 2, the mantle of the present invention comprises a mantle body 20 having side walls defining an essentially hollow tubular shape. The hollow interior of the mantle body is adapted for fitting over main shaft 12. As is conventional, a grouting compound is used to affixed the mantle body on the main shaft so that the mantle body rotates with the shaft. The exterior surface of the mantle body has a frusto-conical configuration and is preferably a one piece low alloy steel casting.

The exterior surface 22 of mantle body 20 provides a surface on which a plurality of wear plates 25 are removably mounted. In the embodiment shown, wear plates 25 are arranged in two rows about the circumference of exterior surface 22 of the mantle body.

Each wear plate is an essentially rectangular member having at least one bore 29 extending therethrough to allow for attachment to the mantle body. Each wear plate is slightly curved as appropriate for fitting about the rounded exterior surface of the mantle body. Necessarily, the rectangular wear plates will have tapered side edges 26 to allow adjacent wear plates to fit together as they are arranged in rows about the mantle body.

The wear plates are arranged in two rows in the illustrated embodiment of the present invention. The lower row of plates experiences greater wear and creating a separate row in this high wear area allows for independent replacement of the row as it wears out. Note in FIG. 2, that the cross-sectional view through the wear plates shows that the lower row of wear plates increase in thickness from top to bottom to allow for the extra wear experience at this location. In the illustrated embodiment, the upper row uses 12 relatively wide plates and the lower row uses 18 relatively narrow plates. Obviously, other arrangements of the wear plates about the mantle body are possible, it being sufficient that the mantle body 20 is completely covered by the wear plates. It is conceivable that a single row of wear plates could be used with each plate extending the length of the mantle body.

Preferably, for best wear, the wear plates are formed from chrome-molybdenum steel having a hardness greater than 360 Brinell.

An adhesive filler material 31 comprising an adhesive grouting compound is used between the mantle body 20 and the wear plates 25 to attach the plates to the body. A grouting compound available under the trademark Nordbak grouting was used with a prototype mantle built according to the present invention, and any grouting compounds having similar characteristics may be substituted. When applying the wear plates to the mantle body, a coating of grout is placed on the exterior surface of the mantle body. The grout acts to fill any voids between the wear plates and the mantle body which, if present, could cause potential breakage problems. The wear plates are shaped and sized such that a space is left between adjacent plates into which the grouting compound can flow as the plate is tightened against the mantle body to fill any voids. The grout ensures that the wear plates are securely attached to the mantle body.

Each wear plate is removably located on the mantle body by locating means comprising a plurality of cavities 27 in the walls of the mantle body having locking means for accepting and retaining fasteners 28 which pass through bores 29 of the wear plates to securely locate the plates to the exterior of the mantle body with retaining means 30.

FIG. 3 provides an exploded view of a preferred embodiment of a locating means. Fasteners 28 comprise a bolt having a head 34 and a threaded shaft 35. Cavity 27 is rectangular in shape and extends through the mantle body from the exterior surface 22 to the hollow interior. The locking means for fasteners 28 comprise an integrally formed flange 32 that partially covers cavity 27 dividing the cavity into a covered portion 36 and an uncovered portion 38. The uncovered portion defines a passage dimensioned to slidably accept head 34 and shaft 35 of the fastener. Flange 32 of cavity 27 defines a holding recess 37 directly behind the flange dimensioned to accept and house head 34. The flange has a semi-circular cutaway section 39 that allows for shaft 35 to extend out of the holding recess when head 34 is positioned therein.

A wedge block 40 is also provided for fitting into the passage defined by uncovered portion 38 to lock the fastener in place.

The locating means just described is used in the following manner:

The head of a fastener is inserted through the passage defined by uncovered portion 38 and then slid over to one side such that head 34 is beneath flange 32 in holding recess 37 and shaft 35 extends through cutaway section 39. Wedge block 40 is then inserted in the passage defined by covered portion 38 to lock the fastener in place with no possibility of rotation.

A bore 29 of wear plate 25 is then aligned and fitted over protruding shaft 35. Retaining means 30 comprising a tightening nut and a lock nut is then tightened to an appropriate torque to hold the wear plate on shaft 35 against the exterior surface 22 of the mantle body.

This method of location provides a simple and convenient way of locating the wear plates to the mantle body. The wedge block ensures that there is no possibility of the fastener rotating within the holding recess allowing the nuts to loosen and the wear plate to come loose.

A back plate 45 is spot welded to the interior surface of the mantle body to seal the interior of each cavity 27. This is necessary as the mantle body is placed on the main shaft using a grouting compound to firmly adhere the mantle body to the main shaft. Backing plates 45 prevent the grouting compound from entering and clogging cavities 27.

Interlocking means are provided between the mantle body 20 and the wear plates 25 to absorb the shear forces which the plates experience. As best shown in FIGS. 2 and 3, these interlocking means comprise a protruding portion 50 formed on the rear surface of each wear plate and a corresponding recess 51 formed in the side walls of the mantle body about each cavity 27. The interlocking means provide for a tight interfit between the wear plate and the mantle body to accept shear stresses, as well as assisting in preventing rotation of the wear plates with respect to the mantle body. Additionally, the interlocking means simplify the job of positioning a wear plate on a protruding shaft by performing a convenient aligning function.

In the illustrated embodiments of the present invention, each wear plate is attached by two locating means. The present invention is not limited to such an arrangement of locating means, and other arrangements are obviously possible with a corresponding re-arrangement of the cavities 27 on the mantle body.

An alternative locating means is shown in FIG. 4. FIG. 4 is a view taken from within the hollow interior of the mantle body. As with the previous locating means, there is a fastener 28 having a head 34 and a threaded shaft 35. An integral covering plate 60 is formed over each cavity 27 defining a holding recess 61. Backing plate 64 is spot welded over the interior end of cavity 27 to cover the holding recess. The integral covering plate 60 is formed with a central aperture 62 dimensioned to accept head 34. On the underside of covering plate 60 facing the interior of the mantle body, there are formed a pair of depressions 68 on either side of the central aperture at right angles to the long axis of central aperture 60. In use, the head 34 of a fastener is inserted through aperture 60 into the holding recess. The fastener is then rotated through ninety degrees as shown by arrow 66 so that head 34 aligns with and seats into depressions 68. When a wear plate 25 is tightened in place over shaft 35, head 34 is held in place within the depressions to prevent rotation and subsequent loosening of the fastener.

The mantle of the present invention is installed and used in a gyratory crusher in the same manner as a conventional manganese steel casting mantle.

The fasteners and nuts that secure the wear plates to the mantle body will wear at the same rate as the material of the wear plates. When the wear plates are worn sufficiently to warrant replacement, the mantle body is removed from the main shaft 12 and the fasteners turned off or cut off, if necessary, to release the worn wear plates. The mantle body is cleaned and refitted with new wear plates. Alternatively, the plates 25 can be changed while the mantle is still in place on the main shaft 12 by lowering a worker into the crusher chamber.

Although the present invention has been described in some detail by way of example for purposes of clarity and understanding, it will be apparent that certain changes and modifications may be practiced within the scope of the appended claims.

We claim:

1. A mantle for use with a rock crushing apparatus comprising:

an essentially tubular mantle body having side walls defining an exterior surface and a hollow interior being adapted to fit over the main shaft of a rock crushing apparatus;

wear plates for attachment to the exterior of said mantle body;

an adhesive filling material disposed between said wear plates and said mantle body; and locating means to allow said wear plates to be removably located on said mantle comprising a plurality of fasteners, each fastener having a head and threaded shaft;

a plurality of cavities formed in the side walls of said mantle body opening onto the exterior surface of said mantle body, each cavity having locking means and being adapted to removably receive one of said fasteners such that said threaded shaft protrudes outwardly from the exterior of the mantle body side walls;

bores formed in said wear plates to accept said threaded shafts; and retaining means to locate said wear plates on said threaded shafts against the exterior of said mantle body side walls.

2. A mantle as claimed in claim 1 in which said locking means comprises:

an integral flange over each of said cavities, said flange partially covering said cavity to form said cavity into a covered and an uncovered portion, said uncovered portion defining a passage to slidably accept the head and shaft of said fastener and said covered portion defining a holding recess dimensioned to house said head, said covered portion also having a cutaway section to allow said shaft to extend out of said holding recess; and a wedge block for fitting into said passage defined by said uncovered portion whereby said head of said fastener is inserted through said passage and slid under said covered portion into said holding recess whereupon said wedge block is inserted into said passage to lock said fastener in place.

3. A mantle as claimed in claim 1 in which said locking means comprises:

an integral covering plate over each of said cavities defining a holding recess, said plate having a central aperture dimensioned to accept said head and said shaft of said fastener;

depressions formed on the underside of said covering plate at right angles to said central aperture whereby said head of said fastener is inserted through said aperture into said holding recess and turned through ninety degrees such that said head aligns with and fits into said depressions thereby locking said fastener into place.

4. A mantle as claimed in claim 1 in which said cavities have a back plate attached to the interior surface of said mantle body.

5. A mantle as claimed in claim 1 in which said cavities and said wear plates are formed with interlocking means to withstand shear stresses exerted on said wear plates.

6. A mantle as claimed in claim 5 in which said interlocking means comprises a projection formed on each wear plate and a corresponding recess formed about each cavity to accept said projection.

7. A mantle as claimed in claim 1 in which single wear plates extend along the entire length of said mantle body.

8. A mantle as claimed in claim 1 in which said wear plates are arranged in two upper and lower rows about said mantle body.

9. A mantle as claimed in claim 1 in which said wear plates taper from a relatively narrow cross-section to a thickened cross-section.

10. A mantle as claimed in claim 1 in which said wear plates are formed of chrome molybdenum steel having a hardness greater than 360 Brinell.

11. A mantle as claimed in claim 1 in which said mantle body comprises a frusto-conical section.

12. A mantle as claimed in claim 1 in which said adhesive filler material is a grouting compound.

* * * * *